United States Patent [19]

Hayashi

[11] 4,124,111

[45] Nov. 7, 1978

[54] COIN INSPECTING APPARATUS

[75] Inventor: Yukichi Hayashi, Sakado, Japan

[73] Assignee: Nippon Coinco Co. Ltd., Japan

[21] Appl. No.: 746,803

[22] Filed: Dec. 2, 1976

[30] Foreign Application Priority Data

Dec. 2, 1975 [JP] Japan ..... 50-163254[U]

[51] Int. Cl.[2] ..... G07F 3/02

[52] U.S. Cl. ..... 194/102; 194/100 A

[58] Field of Search ..... 194/97 R, 100 R, 99, 194/100 A, 102; 73/163; 209/81 R, 81 A

[56] References Cited

U.S. PATENT DOCUMENTS

| | | | |
|---|---|---|---|
| 3,682,286 | 8/1972 | Pramm | 194/100 A |
| 3,901,368 | 8/1975 | Klinger | 194/100 A |
| 3,918,564 | 11/1975 | Heiman et al. | 194/100 A |
| 3,962,627 | 6/1976 | Ptacek et al. | 194/100 A X |

FOREIGN PATENT DOCUMENTS

| | | | |
|---|---|---|---|
| 1,401,363 | 7/1975 | United Kingdom | 73/163 |

*Primary Examiner*—Joseph J. Rolla

[57] ABSTRACT

In a coin inspecting apparatus wherein two secondary coils of a differential transformer are disposed along a coin passage and connected in series opposition, the secondary coils are disposed with a spacing smaller than the diameter of the coin and the level of the output of the secondary coils is detected to determine the diameter of the coin. In a modification two sets of the secondary coils are provided to inspect not only the diameter but also the material and the surface pattern of the coin.

8 Claims, 26 Drawing Figures

COIN INSPECTING APPARATUS

BACKGROUND OF THE INVENTION

This invention relates to an electronic coin inspecting apparatus capable of detecting the diameter, material or surface pattern of coins.

Accurate judgement of genuine and counterfeit coins is one of important problems for automatic dispensers and money exchange machines. In order to improve the accuracy of judgement, it is desirable to check all characteristics of coins (material, surface embossed pattern, outer diameter, etc.) so as to judge that the coins satisfying these characteristics are genuine. An electronic coin inspecting apparatus has recently been proposed wherein such characteristics as the material and the surface pattern are electronically examined. However, the diameter can be inspected only by mechanical means so that where various types of coins are to be inspected it is necessary to provide independent coin sorting passages for different diameters, thus complicating the construction and increasing the size of the apparatus.

SUMMARY OF THE INVENTION

It is an object of this invention to provide a coin inspecting or sorting apparatus capable of electronically inspecting the diameter of the coins.

Another objcect of this invention is to provide an improved electronic coin inspecting apparatus provided with circuit means that determines not only the diameter but also the material and the surface pattern of the coin under inspection.

According to one aspect of this invention, there is provided a coin inspecting apparatus of the type wherein two secondary coils of a differential transformer are disposed along a coin passage and connected in series opposition, characterized in that the spacing between the two secondary winding in made smaller than the diameter of the coin to be inspected and having the smallest diameter thereby producing a measured level from the secondary coils which varies in accordance with the diameter of the coin under inspection.

According to another aspect of this invention, there is provided a coin inspecting apparatus of the type wherein a coin detection coil is arranged along a coin passage, characterized by a circuit for performing a substantially constant integration of the level of the output of the detection coil, and a circuit for judging whether a coin under inspection is genuine or counterfeit in accordance with the result of integration of the first mentioned circuit.

According to another aspect of this invention, there is provided a coin inspection apparatus of the type wherein a differential transformer is disposed along a coin passage, characterized in that there are provided at least two detection coils constituting the secondary coils of the differential transformer and disposed along the coin passage at a spacing smaller than the diameter of a coin under inspection, and means for detecting the diameter of the coin in accordance with the output level of one detection coil when the output level of the other detection coil reaches a predetermined value.

According to still another aspect of this invention, there is provided a coin inspecting apparatus of the type wherein a coin detection coil is arranged along a coin passage, characterized by a circuit which checks the width of a time interval during which the output produced by the detection coil when a coin passes through the coin passages becomes higher than a predetermined level thereby judging the diameter of the coin under inspection in accordance with the width.

DESCRIPTION OF THE PREFERRED EMBODIMENTS

Figure 2:
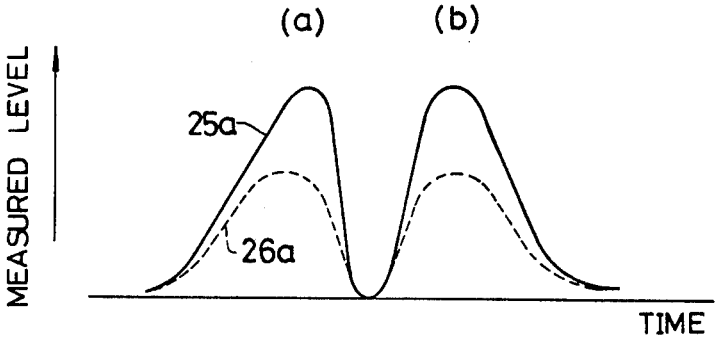
FIG. 2 is a graph showing variation in the peak of the measured level caused by the variation in the coin diameter.

A preferred embodiment of the coin diameter inspector 20 of this invention has two secondary coils 21 and 22 which are connected in series operation. The spacing Y between these coils is set to be smaller than the radius of the coin having the smallest diameter among a variety of types to be inspected. Then, before the center of a coin to be inspected has fallen through a passage or chute 24 passes through the upper coil 21, the coin begins to have an influence upon the lower coil 22, thereby decreasing the peak of the measured level obtained by coil 21. For example, when the center of a small coil 25 passes through the upper coil 21, only a small portion of the coin is received in the lower coil 22 so that the decrease in the peak of the measured level is small as shown by a solid line 25*a* of FIG. 2. However, when the center of a larger diameter coin 26 passes through the coil 21, the portion of the coin received in the lower coil 22 is large with the result that the decrease in the peak of the measured level is large as shown by dotted line 26*a* of FIG. 2. The reason that the measured level decreases by the simultaneous influence of a coin upon both coils can be attributed to the fact that two coils 21 and 22 are connected in series opposition. A primary coil 23 for the secondary coils secondary coils whereby the variation in the coupling coefficient caused by the passage of the coin is measured by the secondary coils. In FIG. 2, the left hand portion (*a*) shows the measured portion of the upper coil 21 and the right hand portion shows that of the lower coil 22.

Figure 1:
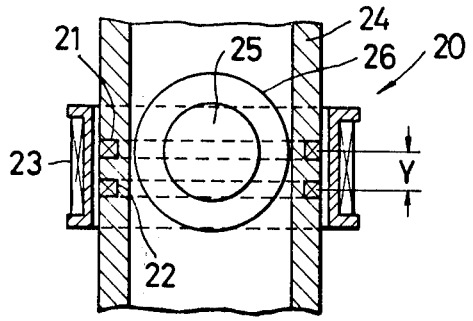
FIG. 1 is a longitudinal sectional view showing one embodiment of the coin diameter inspector of this invention.
Figure 3:
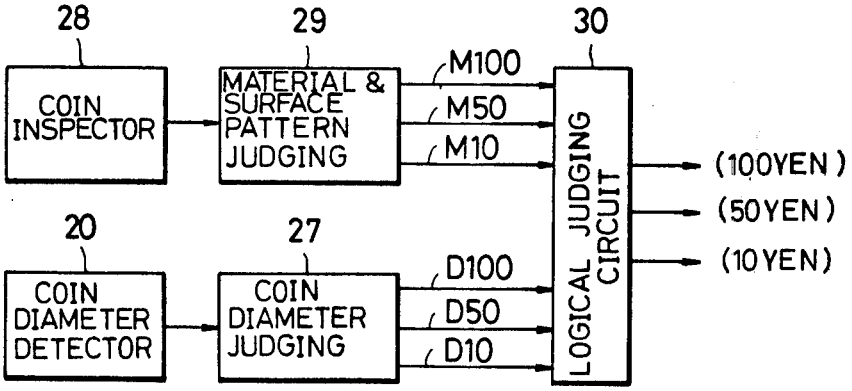
FIG. 3 is a block diagram of the inspecting apparatus utilizing the coin diameter inspector shown in FIG. 1.

FIG. 3 is a block diagram showing one example of the inspecting apparatus utilizing the coin diameter inspector shown an FIG. 1. As shown, the measured level obtained by a coin diameter detector 20 is applied to a coin diameter judging circuit 27 to determine the type (outer diameter) of the coin under inspection by the measured level which varies in accordance with the diameter of the coin as above described. For example, output D100, D50 and D10 are produced from the judging circuit 27 in accordance with the diameters of 100, 50 and 10 Yen coins respectively. Further, a coin inspector 28 as shown in FIG. 1 of a German patent application P 2133725.7 filed on July 7, 1971, is provided. The output of the coin inspector 28 is applied to a judging circuit 29 which determines the material and the surface pattern of the coin for producing outputs M100, M50 and M10 in accordance with 100, 50 and 10 Yen coins, respectively. A logical judging circuit 30 is constituted by AND gate circuits, for example, so as to produce 100, 50 and 10 Yen genuine coin detection signals when the outputs D100 and M100 for the 100 Yen coin, outputs D50 and M50 for the 50 Yen coin and the outputs D10 and M10 for the 10 Yen coin are generated simultaneously.

Although in the foregoing embodiment the coin diameter is detected by narrowing the spacing between the secondary coils of a differential transformer, it is also possible to electrically determine the coin diameter even when the spacing between the secondary coils is made to be equal or larger than the diameter of the coin to be inspected.

Figure 4:
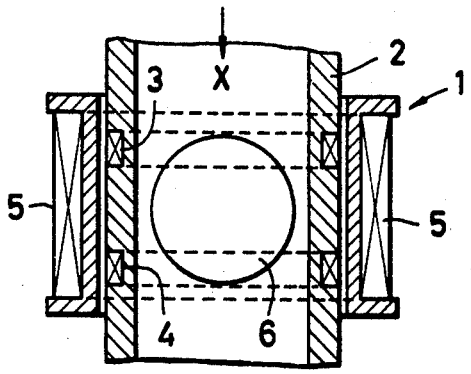
FIG. 4 is a longitudinal sectional view showing a modified coin diameter inspector.

Modified embodiments of this invention are shown in FIGS. 4 through 8. FIG. 4 shows a longitudinal section of a modified coin diameter inspector 1 comprising a differential transformer including two secondary coils 3 and 4 wound about a coin passage 2 and a primary coil 5 surrounding the secondary coils 3 and 4. The secondary coils are connected in series opposition and exited by a signal having a predetermined frequency (about 200 KHz) suitable to detect the material of the coin so that the measured level corresponding to the variation in the coupling coefficient caused by the passage of a coin 6 falling down as shown by an arrow *x* can be produced by the secondary windings.

Figure 5:
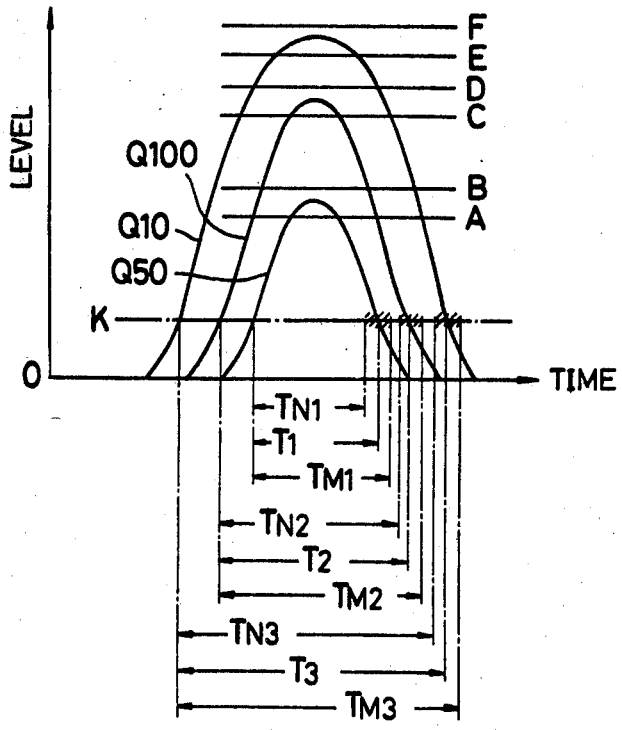
FIG. 5 is a graph coins obtained by the coin diameter inspector shown in FIG. 4.

FIG. 5 is a graph showing typical measured levels of genuine coins obtained by the coin diameter inspector 1 wherein curves Q10, Q50 and Q100 show measured levels of 10, 50 and 100 Yen coins, respectively. Time intervals $T_1$, $T_2$ and $T_3$ for which the measured levels of the genuine coins exceed a predetermined reference level K are used for inspection as the response times of the genuine coins. More particularly, upper limit response times $T_{M1}$, $T_{M2}$ and $T_{M3}$ and lower limit response times $T_{N2}$, $T_{N2}$ and $T_{N3}$ are set before and after the genuine coin response times $T_1$, $T_2$ and $T_3$ respectively and the ranges between these upper limit response times and the lower limit response times are called reference response times. Accordingly, when the length of interval during which the measured level corresponding to a coin under inspecting is higher than the reference level K is within the range of the reference response time, the coin is judged genuine.

Figure 6:
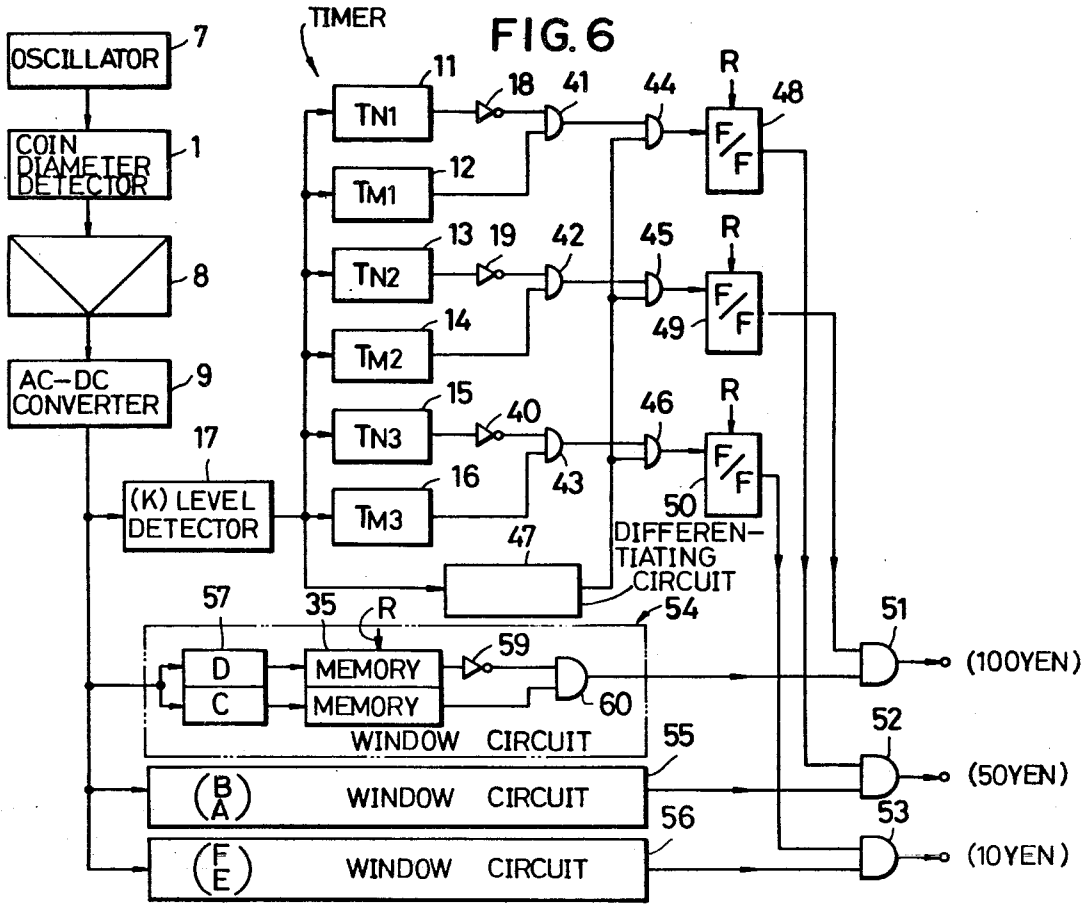
FIG. 6 is a block diagram showing the detail of a coin diameter inspecting apparatus in which timers are utilized to determine the response time.
Figure 7:
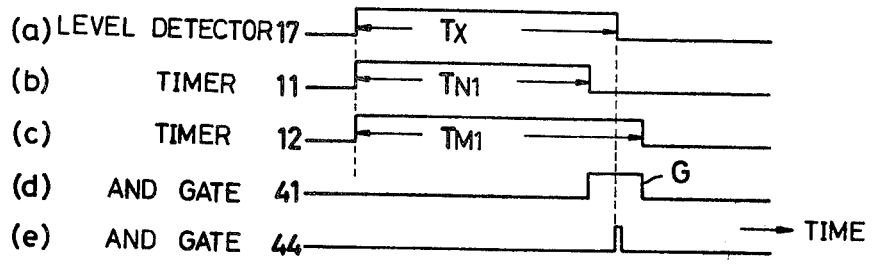
FIG. 7*a* through 7*e* are time charts showing the operation of various elements utilized in the circuit shwon in FIG. 6.

FIG. 6 is a block diagram showing the detail of the coin diameter inspecting apparatus of this invention which is constructed to determine the response time by timers 11 through 16. An oscillator 7 is provided to apply a voltage of a predetermined frequency to the primary coil 5 of the coin diameter detector 1 and the measured voltage derived out from the secondary coils 3 and 4 is applied to an AC - DC converter 9 through an amplifier 8 to produce a DC level. A level detector 17 connected to the output of the AC - DC converter 9 produces a binary output signal "1" when the measured level exceeds the present reference level K whereas a binary "0" output signal is produced when the measured level decreases below the reference level K. Timers 11 and 12 are set with the lower limit responce time $T_{N1}$ and the upper limit response time $T_{M1}$ respectively regarding a 50 Yen coin. Timers 13 and 14 are set with the lower limit response time $T_{N2}$ and the upper limit response time $T_M$ respectively regarding a 100 Yen coin whereas timers 15 and 16 are set with the lower limit response time $TN_2$ and the upper limit response time respectively regarding a 10 Yen coin. The interval $T_x$ (FIG. 7*a*) of the output "1" from the level detector 17 corresponds to the measured response time of the inspected coin. Accordingly, when the coutput from the level detector 17 changes "1", timers 11 through 16 are operated to produce a "1" signal until respective set time $T_{n1}$ through $T_{M3}$ elaspse. For example, timers 11 and 12 operate as shown in FIGS. 7*b* and 7*c*.

The outputs from timers 11, 13 and 15 which are respectively set with lower limit response times $T_{N1}$, $T_{N2}$ and $T_{N3}$ are inverted by inverters 18, 19 and 40 and then applied to adders 41, 42 and 43. On the other hands, the outputs from timers 12, 14 and 16 respectively set with the upper limit response times $T_{M1}$, $T_{M2}$ and $T_{M3}$ are applied directly to AND gate circuits 41, 42 and 43. Consequently, AND gate circuits 41, 42 and 43 produce output "1" between the terminations of the lower limit response times $T_{N1}$, $T_{N2}$ and $T_{N3}$ and the terminations of the upper limit response times $T_{M1}$, $T_{M2}$ and $T_{M3}$, respectively. The output from the AND gate circuit 41 is shown by FIG. 7*d*. In short, in the AND gate circuits 41 through 43, a timed gate pulse G regarding the end point of the reference response time for various coins is formed. When the output from the level detector 17 changes to "0", that is, when the measuring response time terminates, during the interval of this timed gate pulse the diameter of the coin under inspection is judged that it is the diameter of a genuine coin. The outputs from the AND gate circuits 41, 42 and 43 are applied to one inputs of AND gates circuits 44, 45 and 46 respectively, and the build down of the output from the level detector 17 is detected by a differentiating circuit 47 for a one shot circuit for applying a build down detection pulse to respective AND gate circuits 44, j45 and 46. As shown in FIG. 7*a*, if the output from the level detector 17 changes to "0" from "1" during the interval of the gate pulse G for the AND gate circuit 41, the output from the AND gate circuit 44 will become "1" as shown in FIG. 7*e*, and this "1" signal will be stored in a memory circuit 45 for storing the result of inspection of the diameter of a 50 Yen coin. In the circuit shown in FIG. 6, when the gate pulse G for 100 Yen coins is generated by the AND gate circuit 42 and when the gate pulse G for the 10 Yen coins is generated by the AND gate circuit 43, the conditions of the AND gate circuit 45 and 46 would not hold because the output from the level detector 17 has already been changed to "0". Accordingly, the contents of the memory circuits 49 and 50 respectively storing the results of inspection of 100 and 10 Yen coins respectively are "0" and the content of only the memory circuit 48 is "1".

The outputs from memory circuits 48, 49 and 50 are applied to one of the inputs of the AND gate circuits 52, 51 and 53 respectively for 50, 100 and 10 Yen coins. To the other inpute of these AND gate circuits are applied the outputs from window circuits 54, 55 and 56 for inspecting 100, 50 and 10 Yen coins respectively. The measured level of the coin detector 1 is applied to respective window circuits 54, 55 and 56 through the AC - DC converter 9, thus inspecting the material of the coin. Each window circuit judges the material of the coin by utilizing the fact that the peak of the measured level is different depending upon the material. The upper limit values of the levels B, D and F and the lower limit values of the levels A, C and E shown in FIG. 5 are set in respective window circuits 54, 55 and 56, so that these window circuits produce signal "1" when the peak value of the measure level of the coin detector 1 lies between the set values of the upper and lower limits. Taking the window circuit 54 for inspecting 100 Yen coins, for example, the level detector 57 produces a "1" signal when the measured level becomes higher than the low limit value C or higher than the upper limit value D. Consequently, so long as the measured level lies in a reference level range between the lower limit value and the upper limit value, the output of the lower limit value C is "1" whereas the output of the upper limit value D is "0", and these signals are stored in the memory circuit 35. The output of this memory circuit regarding the upper limit value D is inverted by an inverter 59 and then applied to one input of an AND gate circuit 60. Consequently, so long as the peak value of the measured level is contained in the reference level range for genuine coins, the condition of the AND gate circuit 60 holds thus producing an "1" signal.

In this manner, the result of inspection of the outer diameter of the coin under inspection and the result of inspection of the characteristics thereof (for example material) other than the diameter are applied to the AND gate circuits 51, 52 and 53 respectively so that the condition of either one of these AND gate circuits is satisfied when both results of inspection safisfy a prescribed reference of a genuine coin, these judging the coin as a genuine one. For example, when a 50 Yen coin is inserted, both the memory circuit for storing the result of inspection of 50 Yen coins and the window circuit 55 for 50 Yen coins produce "1" signals, and the AND gate circuit 52 produces a "1" signal. If a counterfeit coin made of lead and having the same diameter as the genuine 100 Yen coin is inserted, the detector 1 often produces a measured level resembling to that of a 50 Yen genuine coin. In such a case, although the window circuit 55 procudes signal "1" which represents a genuine 50 Yen coin, as the diameter of a 100 Yen coin is detected and as signal "1" is stored in the memory circuit 49 the condition of the AND gate circuit 51 for 100 Yen coins and that of the AND gate circuit 52 for 50 Yen coins is not satisfied so that the outputs of all AND gate circuits 51, 52 and 53 are "0" . Accordingly, it is judged that the inserted coin is a counterfeit coin. Thus, the judgement of the genuine and counterfeit coins is made with a high accuracy.

Figure 8:
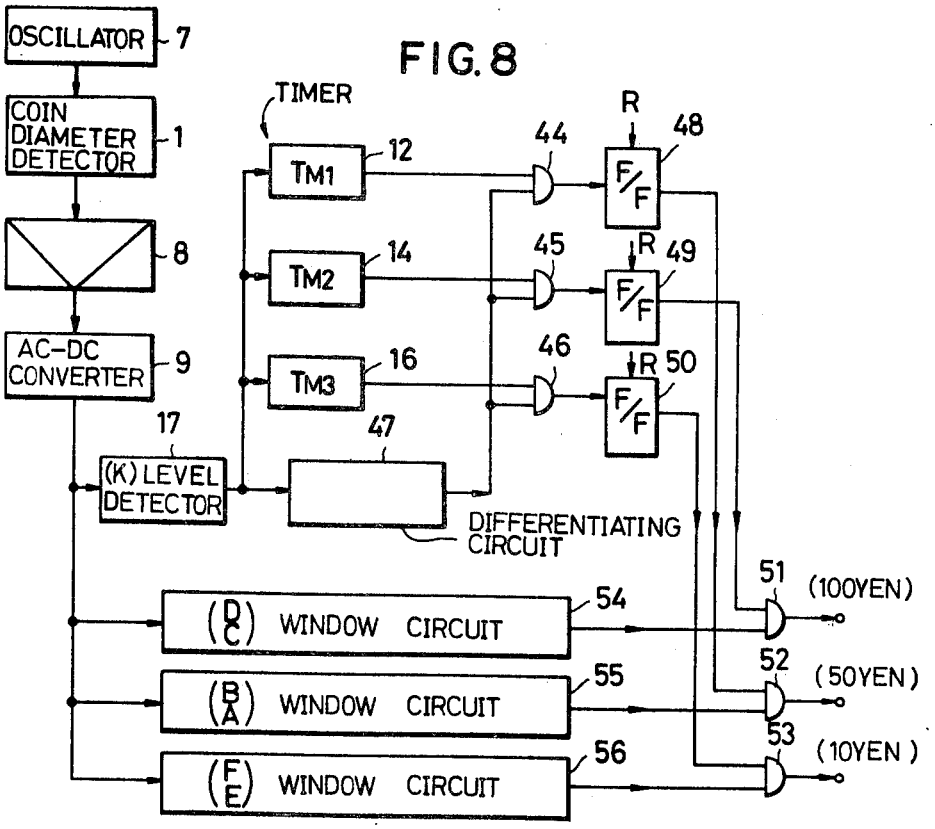
FIG. 8 is a block diagram showing a modification of the detection circuit shown in FIG. 6.

FIG. 8 is a block diagram showing a modification of the circuit shown in FIG. 6, wich is constructed to check the width of the response time of the measured level by taking only the upper response times $T_{M1}$, $T_{M2}$, T and $T_{M3}$ as the references. It is advantageous to combine this construction with the window circuits 54, 55 and 56 shown in FIG. 6 for inspecting the material of the coin.

More particularly, when a counterfeit coin is made of lead to have a similar peak value of the measured level, the diameter of the counterfeit coin is generally larger than that of a genuine coin. For example, where one makes a counterfeit 100 Yen coin of lead such that it will have the same peak value of the measured level as that of a genuine 100 Yen coin, the window circuit for inspecting the material of 100 Yen coins may inadvertently judge it as a genuine 100 Yen coin. However, the diameter of the inserted coin is generally larger than a 100 Yen genuine coin so that when inspecting the diameter, it is sufficient to judge that whether the outer diameter of the inserted coin is less than the upper limit value (genuine coin) or above the upper limit value (counterfeit coin).

In FIG. 8, the circuit elements identical to those shown in FIG. 6 are designated by the same reference charactors. Timers 12, 14 and 16 are set with only the upper response times $T_{M1}$, $T_{M2}$ and $T_{M3}$ of respecitve coins. When the output from the level detector 17 is less than the upper response time, since respective timers 12, 14 and 16 apply "1" signals to one inputs of AND gate circuits 44, 45 and 46 so that a pulse produced by the differentiating circuit 47 when the measured level is less than the reference level K is stored in memory circuits 48, 49 and 50 through AND gate circuits 44, 45 and 46, respectively. As can be noted from FIG. 5, since the diameter of the 50 Yen genuine coin is the smallest, when a 50 Yen coin is inserted, the output from the level detector 17 becomes less than any one of the upper limit response times $T_{M1}$, $T_{M2}$ and $T_{M3}$ so that all memory circuits 48, 49 and 50 store "1" signal. However, as only the output from the window circuit 55 for inspecting 50 Yen coins becomes "1" the condition of only the AND gate circuit 52 in satisfied thus judging the inserted coin as a genuine 50 Yen coin. Since in this example, it was assumed that the outer diameter of a counterfeit coin prepared to have similar peak value is generally larger, for a cunterfeit coin, the circuit is constructed such that the condition of all AND gate circuits 51, 52 and 53 will not be satisfied. Let us assume now that a counterfeit coin prepared to have the same peak value of the measured value of a genuine 50 Yen coin is inserted. Since the diameter of such counterfeit coin is generally larger than the upper limit of the diameter of the genuin 50 Yen coin, the measured level would decrease below the reference level K only after the upper limit response time $T_{M1}$ of the timer 12 for 50 Yen coins has elapsed. If the elapsed time is less than the upper response times $T_{M2}$ and $T_{M3}$ for 10 and 100 Yen coins the output from the AND gate circuit 44 is "0" whereas those of the AND gate circuit 45 and 46 are "1". Consequently, the AND gate circuit 52 for 50 Yen coins is disenabled whereas the AND gate circuits 51 and 53 for 100 and 10 Yen coins are enabled. However, since only the output from the window circuit 55 for 50 Yen coins is "1" and since the outputs from other window circuits 54 and 56 are "0", the conditions of all AND gate circuits 51, 52 and 53 is not satisfied, whereby the inserted coin is judged as a counterfeit coin. Upon completion of the inspection of one coin, all memory circuit 48, 49 and 50 are reset by a reset signal R.

In the foregoing embodiments, timers are used to judge the response time of the measured level but it is also possible to construct the circuit such that a clock pulses are selected only when the measured level exceeds the reference level K, that the number of the selected clock pulses is counted by a counter and that the count of the counter is compared with a set count value of the diameter of a genuine coin.

Figure 9:
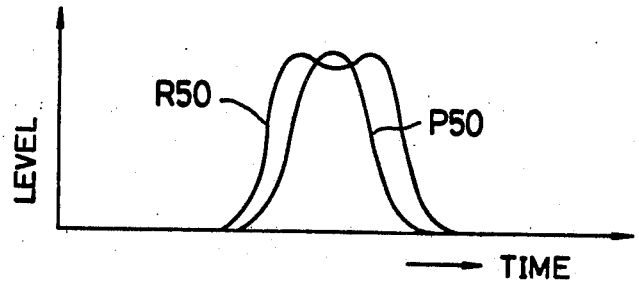
FIG. 9 is a graph showing detected levels of a 50 Yen counterfeit coin (no aperture) and a 50 Yen genuine coin (with an aperture).
Figure 10:
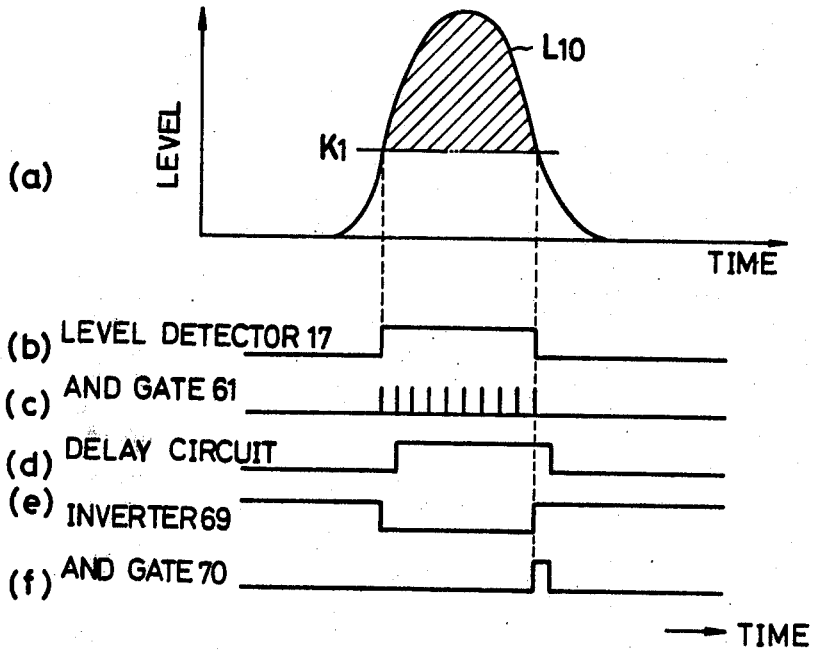
FIG. 10*a* through 10*f* show graphs useful to explain the operation of the circuits shown in FIGS. 6 and 11.
Figure 11:
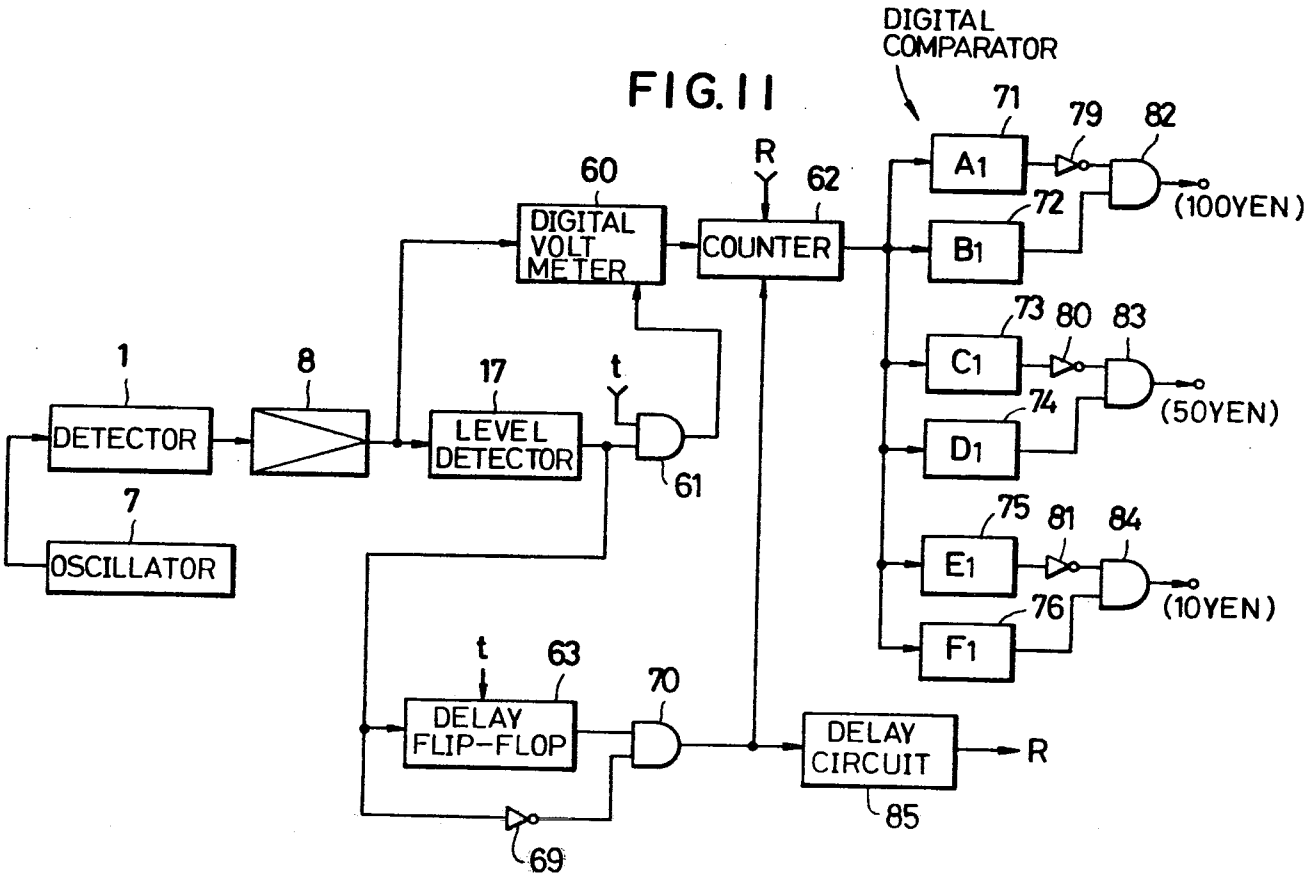
FIG. 11 is a block diagram showing still another modification of this invention.

FIG. 9–11 show another embodiment of the coin inspecting apparatus according to the invention. This embodiment employs the same coin detector as shown in FIG. 4 and further a coin detection circuit which substantially integrates the detected level provided by the coin detector and discrimites a genuine coin from a counterfeit coin on the basis of the result of the integration.

According to this modification, since whether the coin is genuine or counterfeit is judged by the total area of the detected level instead of the peak value, it is possible to reject a counterfeit coin prepared to have the same peak value with a higher accuracy.

In this coin inspecting apparatus, as ma method of performing a substantially constant integration, the detected level $L_{10}$ above a predetermined level $K_1$ is integrated as shown in FIG. 10*a*. The integration is made by sequentially adding the detecting levels $L_{10}$ (the passage of respective coins) above the reference level K.

In FIG. 11 the detector 1 is identical to that shown in FIG. 4 and disposed about a coin passage, not shown, to be operated by the coin, not shown, passing therethrough. For example, the detector 1 is constructed as a diffenential transformer including a primary coil excited by a high frequency oscillator 7 and a secondary coil producing an analogue output in accordance with the variation in the coupling coefficient caused by the passage of a coin.

The output from the detector 1 is applied to a level detector 17 and a digital volt meter 60 via an amplifier 8. The purpose of the digital volt meter 60 is to convert the digital detected level into an analogue signal and, when applied with a pulse from an AND gate circuit 61, it sends the converted digital signal to a counter 62. The level detector 17 produces a signal "1" when the level of the output from the detector 1 becomes higher than a predetermined level K, whereas when the output level is as shown in FIG. 10*a*, it produces an output as shown in FIG. 10*b*. The output from the level detector 17 is applied to one input of an AND gate circuit 61 so as to cause it to select a clock pulse *t* as shown in FIG. 10*c*. In this manner, the clock pulse *t* produced by the AND gate circuit 61 when the output level of the detector 17 is higher than level $K_1$ is applied to the digital volt meter 60. The detected level of the coin converted into a digital signal by the digital volt meter 60 is sampled at the timing of the clock pulse *t* and applied to a counter 62 which sequentially integrates the digital signal (binary value) and stores the result of integration. When the detected level $L_{10}$ of the coin (FIG. 10*a*) decreases below the predetermined level $K_1$ the AND gate circuit 61 is disenabled so that the clock pulse *t* is not sent to the digital volt meter 60. As a consequence, the digital volt meter does not produce any output thus terminating the integrating operation of the counter 62. Thus, the constant integration of the detected level $L_{10}$ above the predetermined level $K_1$ is completed. The result of integration stored in the counter 62 is the result of integration.

The output from the level detector 17 is also applied to a delay flip-flop circuit 63 and an inverter 69. The delay flip-flop circuits delays the output by one clock pulse while the inverter produces an inverted signal which is applied to an AND gate circuit 70 as shown in FIG. 10*e*. The output pulse from the AND gate circuit 70 as shown in FIG. 10*f* is applied to the counter 62 so as to cause it to produce the result of integration stored therein at the timing of the output pulse. Accordingly, after completion of the integration, the counter 62 produces the result of integration.

The output from the counter 62 is also applied to digital comparators 71 though 76. When the result of integration of the counter 62 is larger than the set values $A_1$, $B_1$, $C_1$, $D_1$, $E_1$ and $F_1$ of respective comparators, each of these comparators produces a signal "1". Respective comparators 71 through 76 are set with the upper and lower limit of the result of integration concerning expected coins. For example, the upper limit set value of a 100 Yen coin is $A_1$ while the lower limit set value is $B_1$. The upper and lower limit set values of a 50 Yen coin are $C_1$ and $D_1$, whereas the upper and lower limit set values of a 10 Yen coin are $E_1$ and $F_1$. Consequently, so long as the result of integration of the detected level of a coin lines in a range between said upper limit set value and the lower limit set value, the coin is judged as genuine.

The outputs from the comparators 71, 73 and 75 which compare the upper limits are applied to one inputs of AND gate circuits 82, 83 and 85, respectively through inverters 79, 80 and 81 while the outputs from the comparators 72, 74 and 76 which compare the lower limits are applied directly to the other inputs of the AND gate circuits 82, 83 and 84 respectively. AND gate circuits 82, 83 and 84 correspond to 100, 50 and 10 Yen coins respectively. When the result of integration is included in a predetermined range, AND gate circuits 82, 83 and 84 produce signals "1". Thus it is judged whether the coin under inspection is genuine or counter-feit as well as the type of the coin.

The output from the AND gate circuit 70 is delayed by a delay circuit 85 to obtain a reset signal *e* which is used to reset to 0 the result of integration of the counter 62 thus preparing for the next inspection.

Although in the foregoing embodiment a circuit was shown in which a digital integration is made, it will be clear that it is possible to construct the circuit to perform an analogue integration.

According to the integration method described above, discrimination of a genuine coin from a counterfeit coin may be made accurately even if a counterfeit coin having the same peak as the one of a genuine coin is thrown in.

It will be apparent from FIG. 9 that if, for example, a genuine 50 Yen coin having an aperture has a level characteristic shown by reference characters R50, a genuine 50 Yen having an aperture coin can be discriminated from a solid counterfeit 50 Yen coin having a level characteristic P50 which is the same as the one of the genuine coin by the above described integration method.

Figure 12:
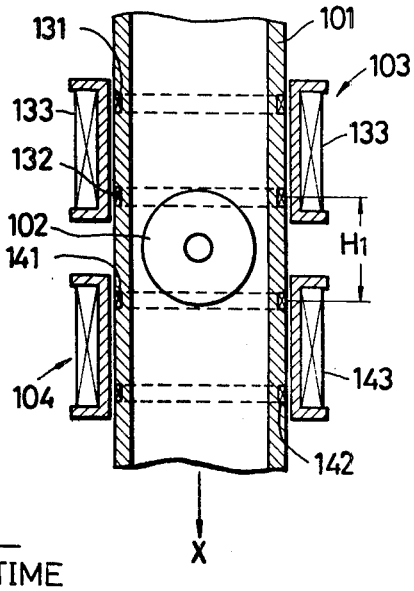
FIG. 12 is a longitudinal sectional view of a modified coin diameter inspector.
Figure 13A:
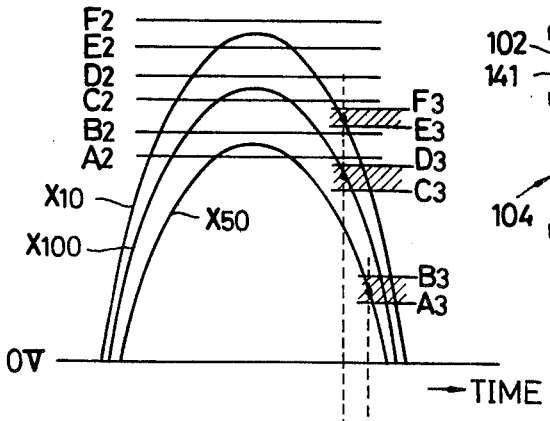
FIG. 13*a* and 13*b* are graphs showing the output levels produced by the detectors shown in FIG. 12.
Figure 13B:
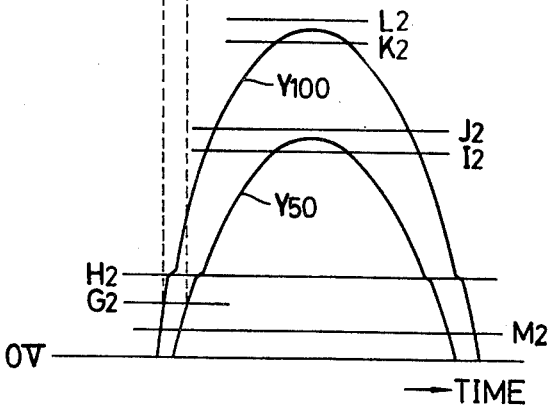
Figure 14:
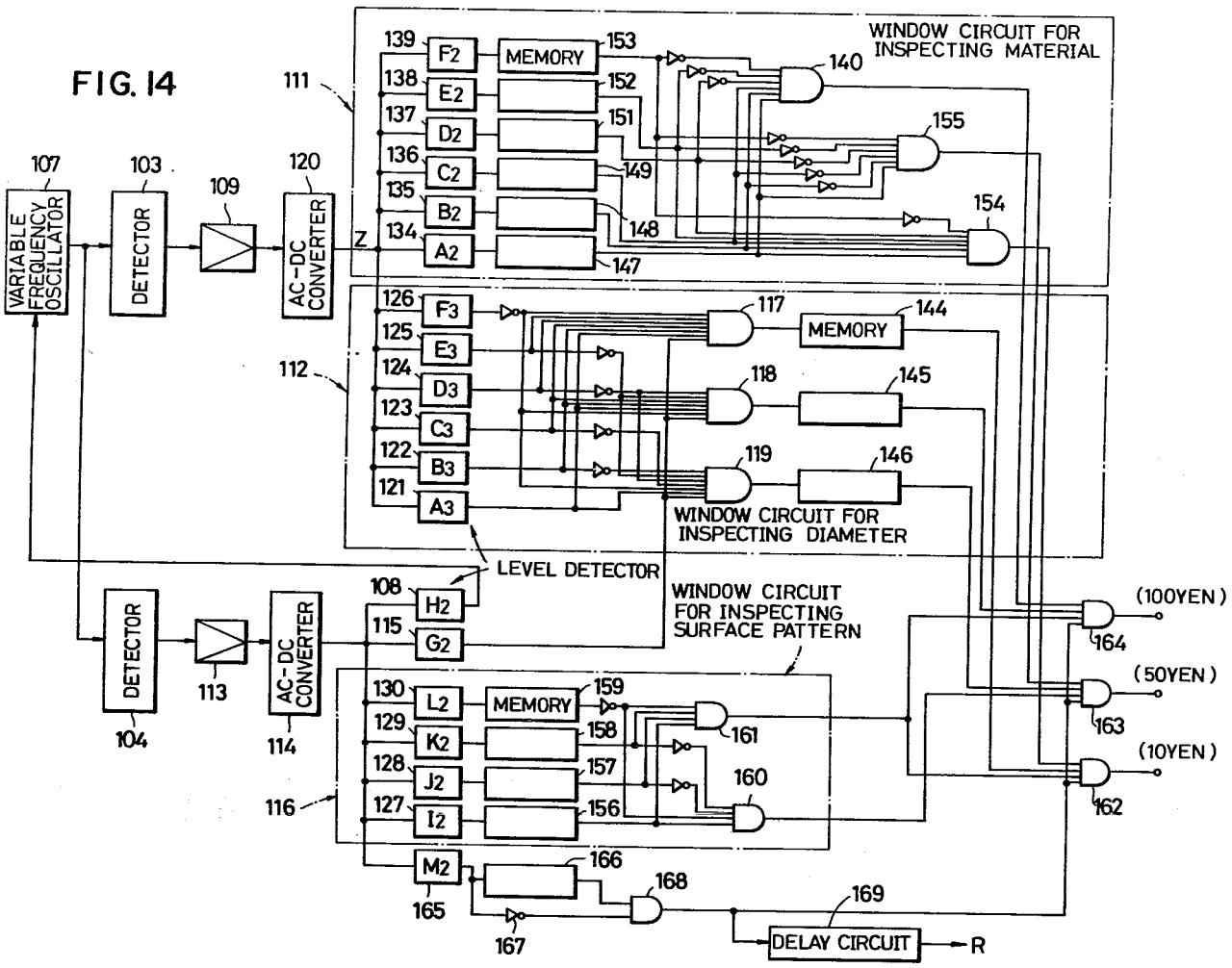
FIG. 14 is a block diagram showing another example of the coin inspecting apparatus utilizing the detectors shown in FIG. 12.

FIGS. 12 through 14 shown another embodiment of this invention. The modified coin diameter inspector comprises a pair of inspectors which are arranged in succession along a coin passage with a spacing between the two adjacent secondary coils of the pair of inspectors smaller than the diameter of the coin so as to inspect the output level of one of the adjacent detection coil (upper coil) when the output level of the other of the adjacent detection coil (lower coil) reaches a predetermined value thereby detecting the diameter of the coin. Since the spacing between two secondary coils is constant, the output level of one detection coil varies with the diameter of the coin. As a concequence, when the output level of one detection coil is included in the range of the detected level which corresponds to the diameter of a genuine coin, that diameter is judged as the diameter of the genuine coin.

More particularly, as shown in FIG. 12, the coin passage 101 is in the form of a slit so that the coin 102 to be inspected can fall down in the direction of its diameter. Detector 103 and 104 comprise secondary coils 131, 132 and 141, 142 which are wound about the coin passage 101 and pairmary coils 133, 143 and respectively surrounding the secondary coils. Detector 103 is used to inspect the material of the coin, whereas the detector 104 to inspect the surface pattern of the coin. Each pair of secondary coils 131 and 132 and 141 and 142 are connected is series opposition so as to cause either one of the secondary coil pairs 131, 132 and 141 and 142 to produce the output level corresponding to the variation in the coupling coefficient between the pairmary and secondary coils. The primary coil 133 for inspecting the meterial of the coin is connected to a source of 200 KHz, for example, not shown, while the primary coil 143 for inspecting the surface pattern is connected to a source of 1 MHz, for example. The connection of these sources are made selectively.

In the embodiment shown in FIG. 12, no particular coil for detecting the coin diameter is not provided, but detectors 103 and 104 are used for this purpose. More particularly, the spacing $H_1$ between the secondary coil 132 of the detector 103 and the secondary coil 141 of the detector 104 is made to be smaller than the diameter of the coin 102 as shown in FIG. 12. Accordingly, the falling coin 102 bridges two coils 132 and 141.

FIG. 13*a* shows one example of the output level produced by the secondary coils 131 and 132 of the detector 103 as the coin falls down and FIG. 13*b* shows the output level produced by the secondary coils 31 and 32 of the detectors, in which curves $X_{10}$, $X_{50}$ and $X_{400}$ show the levels produced by the detector 103 respectively by 10, 50 and 100 Yen coins, and curves $Y_{50}$ and $Y_{100}$ show the levels produced by the detector 104 by 10 and 100 Yen coins respectively. The material or the surface pattern of the coin can be inspected by supervizing that whether the peak values of the output levels of the detectors 103 and 104 are contained in a predetermined ranges $A_2$–$B_2$, $C_2$–$D_2$, $E_2$–$F_2$, $I_2$–$J_2$ and $K_2$–$L_2$, by using a window circuit. The inspection level $G_2$ is the level produced by the secondary coils 141 and 142 when the leading edge of the falling coin 102 passes through the coil 141 of the detector 104 as shown in FIG. 12. This level is set to a predetermined value. Accordingly, when the output of the detector 104 reaches this level $G_2$, it is possible to know that the coin 102 reaches a position at which two coils 132 and 141 of two detectors 103 and 104 are bridged by the coin. The diameter of the coin can be determined by examining the level of the output of the detector 103 at this time. In other words, since the spacing $H_1$ between coils 132 and 141 is constant and since the position of the leading edge of the coin at which the detector 104 produces the predetermined level $G_2$ is also definite (provided that although the diameter is different, the material and the surface pattern and the same) the position of the trailing (or upper) end of the coin that faces the coil 132 of the other detector 103 when the output is at the level $G_2$ varies in accordance with the diameter of the coin. Accordingly, it is possible to determine the diameter of the coin by detecting that whether the output level of the detector 103 is included in a predetermined range ($A_3$–$B_3$ for 50 Yen coin, $C_3$–$D_3$ for 100 Yen coin and $E_3$–$F_3$ for 10 Yen coin) or not when the output level of the other detector 104 reaches level $C_2$ by means of a window circuit.

FIG. 14 is a block diagram showing modified coin inspection apparatus utilizing the outputs of the detector 103 and 104 shown in FIG. 12. As shown, a variable frequency oscillator 107 firstly applies a power source of 200 KHz to the primary coils 133 and 143 of the detectors 103 and 104. The level detector 108 detects that the output level of detector 104 has increased to a value higher than $H_2$(see FIG. 13*b*) due to a coin 102 which has passed through the detector 103 and arrived at the detector 104. Then, the oscillation frequency of the oscillator 107 is switched to 1MHz. The output of the secondary coils 131 and 132 (see FIG. 12 is applied to a window circuit 111 for inspecting the material and a window circuit 112 for inspecting the diameter of the coin through an amplifier 109 and an AC-DC converter 120. In the same manner, the output of the secondary coils 141 and 142 (see FIG. 12) of the detector 104 is applied to level detectors 108 and 115, and a window circuit 116 for inspecting the surface pattern of the coin via an amplifier 113 and an AC-DC converter 114. The level detector 115 momentarily produces an "1" output when the output of the detector 104 reaches a predetermined level $G_2$ and this output is applied to AND gate circuits 117, 118 and 119 of a window circuit 112 for inspecting the coin diameter. Level detectors 121–126 and 134–139 respectively produce a "1" output when the output of detector 103 becomes higher than preset levels $A_3$, $B_3$, $C_3$ . . . $F_3$; $A_2$ $B_2$ . . . $E_2$ and $F_2$ respectively. Level detectors 127–130 respectively produce a "1" output when the output of the detector 104 becomes higher than preset level $I_2$, $J_2$, $K_2$ and $L_2$ respectively.

When the preset level G is detected AND gate circuits 117, 118 and 119 ready for gating out an output. If the inserted coin is a 50 Yen coin the output level Z of the detector 103 is in a range of $A_3 < Z < B_3$ and $Z < C_3$, $D_3$, $E_3$ or $F_3$ (FIG. 13) Accordingly, the outputs of the level detectors 122 through 126 are inverted by inverters and then applied to the inputs of the AND gate circuit 119 while at the same time the output of the level detector 121 is applied to the AND gate circuit 119. Then the condition of this AND gate circuit a satisfied only when $A_3 < Z < B_3$, $C_3$, $D_3$, $E_3$ or $F_3$ thereby detecting the diameter of the 50 Yen coin.

In the case of a 100 Yen coin, the output level Z of the detector 103 is in a range of $C_3 < Z < D_3$ and $A_3$, $B_3 < Z < E_3$, $F_3$ (see FIG. 13) Accordingly, the outputs of the level detectors 124, 125 and 126 inverted by inverters and the outputs of the level detector 121, 122 and 123 are applied to the inputs of the AND gate circuit 118. The condition of this AND gate circuit 118 is satisfied only when $A_3$, $B_3$ $C_3 < D_3$, $E_3$, $F_3$ thus determining diameter of the coin. In the case of a 10 Yen coin the output level Z of the detector 103 is in a range of $E_3 <$ $Z < F_3$ and $A_3$, $B_3$, $C_3$ $D_3 < Z$. (see FIG. 13). Consequently, the output of the level detector 126 inverted by an inverter and the outputs of the level detectors 121 through 125 are applied to the inputs of the AND gate circuit 117. The condition of this AND gate circuit is satisfied only when $A_3$, $B_3$, $C_3$, $D_3$, $E_3 < Z < F_3$ thus detecting the diameter of the 10 Yen coin.

When the diameter of the coin is determined by either one of the AND gate circuits 117, 118 and 119 when the predetermined level $G_2$ is reached, signal "1" is stored in one of corresponding memory circuits 144, 145 and 146. When the diameter of the coin is not determined, all AND gate circuits 117, 118 and 119 produce "0" outputs and signal "1" is not stored in the memory circuit 144, 145 and 146.

The window circuit 111 for inspecting the material and the window circuit 116 for inspecting the surface pattern comprise logical circuits similar to that of the window circuit 112 described above. Thus, in the dindow circuit 111, the outputs from the level detectors 134 through 139 are stored in memory circuits 147 through 153 in the form of flip-flop circuits or the like and the outputs from these memory circuits are applied directly, or through inverters, to an AND gate circuit 154 for 10 Yen coins, an AND gate circuit 155 for 50 Yen coins and AND gate circuit 140 for 100 Yen coins. In the window circuit 116, the outputs from the level detectors 127 through 130 are stored in memory circuits 156 through 159 respectively and the outputs from these memory circuits are applied directly or through inverters to an AND gate circuit 160 for 50 Yen coins and an AND gate circuit 161 for 10 Yen or 100 Yen coins.

As above described, the window circuits 111, 112 and 116 apply to the AND gate circuit 162 for 10 Yen coins outputs regarding the characteristics (material, diameter and surface pattern) of 10 Yen coins, to the AND gate circuit 163 and informationsrregarding 50 Yen coins and to the AND gate circuit 164 the information regarding 100 Yen coins. When three characteristics, that is, the material, diameter and surface pattern judge that the coin is genuine, AND gate circuit 162, 163 or 164 produces a "1" output.

The level detector 165 produces a "1" output when the output level of the detector 104 exceeds the predetermined level $M_2$(see FIG. 136). The output of the level detector 165 is delayed by a delay flip-flop circuit or a memory circuit 166 and then applied to one input of an AND gate circuit 168, the other input thereof being connected to receive the output of the flip-flop circuit 165 through an inverter 167. When the coin 102 passes through detector 104, the output from the level detector 165 changes from "1" to "0" while the output of inverter 167 changes from "0" to "1". At this time, since the output of the delay flop-flop circuit 166 is still maintained at "1" state, the AND gate circuit 168 will produce an "1" output. When the output of the delay flip-flop circuit 166 changes to "0" a definite time later, the output and the AND gate circuit 168 changes to "0". Consequently, when the coin 102 has passed through the detectors 103 and 104, the AND gate circuit 168 produces a pulse which is used to synchronize the output from the AND gate circuits 162 through 164. The output from the AND gate circuit 168 is delayed a predetermined time by a delay circuit 169 to produce a reset pulse R which is used to reset to "0" the contents of the memory circuits 144 through 146, 147 through 153 and 156 through 159 of respective window circuits 111, 112 and 116. Thus, after the AND gate circuit 162, 163 or 164 has produced a detection output of a 10, 50 or 100 Yen coin each one of the memory circuit is reset.

Figure 15:
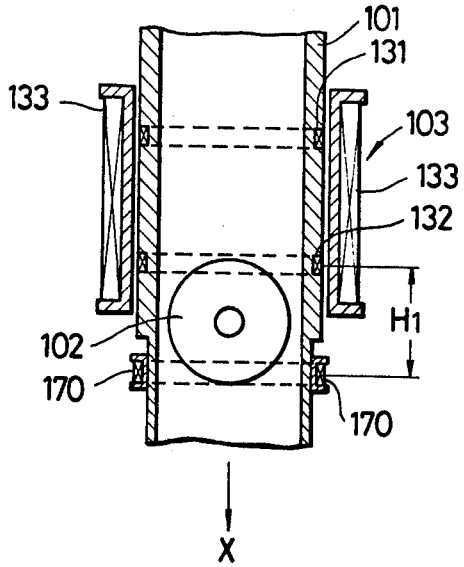
FIG. 15 is a longitudinal sectional view of a modification of the detector shown in FIG. 12.

FIG. 15 shows a modification of the detector shown in FIG. 12 in which a detector 103 is used to detect either one of the material and the surface pattern of a coin, and a coil 170 for detecting the diameter is wound to surround a coin passage 101 at a position spaced by $H_1$ from the secondary coil 132 of the detector 103. The spacing $H_1$ is selected to be smaller than the diameter of the coin as above described. The electric circuit for processing the outputs from the detector 103 and the coil 170 is substantially identical to that shown in FIG. 14 except that the window circuit 116 ais liminated. Thus, the output from the detector 103 is applied to the window circuit 111 for inspecting the material and to the window 112 circuit for inspecting the diameter of the coin. The output from the coil 170 is applied to the level detector 115 for detecting the predetermined level $G_2$.

Figure 16:
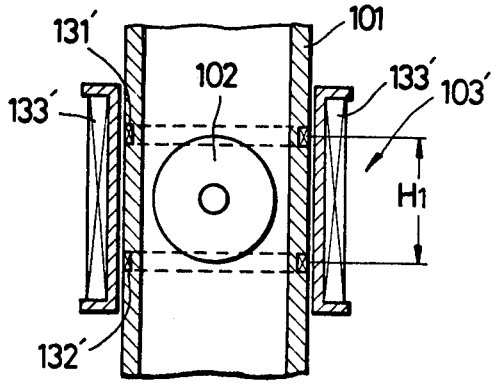
FIG. 16 is a longitudinal sectional view showing yet another modification of this invention.

FIG. 16 shows still another modification of the coin detector of this invention in which only one detector 103' is used. The spacing $H_1$ between two secondary coils 131' and 132' is selected to be smaller than the diameter of a coin 102 to be inspected. Coils 131' and 132' are independently wired. The output of either one of the coils is applied to window circuit 111 (See FIG. 14) for inspecting the material or the surface pattern for checking the material or surface pattern. The output of coil 132' is applied to the level detector 115 (see FIG. 14) for detecting the predetermined level $G_2$ while the output of the other coil 131' is applied to the window circuit 112 for inspecting the diameter whereby the output level of one coil 131' is checked by the window circuit 112 when the predetermined level $G_2$ is detected by the other coil 132'.

What is claimed is:

1. A coin receiving apparatus comprising a coin passage defining member for receiving coins of different diameters, and coin inspection means for classifying coins passing along said coin passage according to diameter, said coin inspecting means including two adjacent detecting coils positioned along said coin passage, at least one of said detecting coils being a secondary coil of a differential transformer also having a primary coil, said two coils being spaced along said coin passage a distance less than the diameter of the smallest diameter coin to be received in said coin passage, a high frequency oscillator connected to said primary coil for exciting said primary coil, a level detector coupled to said two coils for producing an output when the level of the output of said two coils simultaneously influenced by a coin exceeds a predetermined level, and a plurality of timers including one for each diameter of coin to be detected, said timers being connected to the output of said level detector and set with different response times for judging the diameter of a coin passing through said two coils.

2. The coin inspecting apparatus of claim 1 wherein said two coils are both secondary coils of said differential transformer.

3. The coin inspecting apparatus of claim 1 wherein said two coils are secondary coils of two different differential transformers each having a primary coil.

4. The coin inspecting apparatus of claim 1 wherein the other of said two coils is in independent coil spaced from said primary coil.

5. In coin inspecting apparatus of the type wherein a coin detection coil is arranged along a coin passage and has a change in output level when influenced by a coin passing along said coin passage, the improvement which comprises an integration circuit connected to said detector coil for performing a substantially constant integration of the level of the output of said detection coil, and a judging circuit for judging whether a coin under inspection is genuine or counterfeit in accordance with the result of integration of said integration circuit, said integration circuit including a differential transformer having a primary coil and a pair of secondary coils connected in series to act as said detection coil, a high frequency oscillator connected to said primary coil for exciting said primary coil, a digital voltmeter connected to said detection coil for converting a detection analog level from the detection coil into a digital signal, a level detector connected to said detection coil for producing an output when the level of the output from said detection coil exceeds a predetermined level, means responsive to the output from said level detector for applying a clock pulse to said digital voltmeter for causing said digital voltmeter to sample said analog signal, said digital voltmeter having an output, and a counter having a plurality of outputs and being connected to the output of said digital voltmeter for integrating the sampled analog signal.

6. The coin inspecting apparatus according to claim 5 wherein said judging circuit comprises a plurality of sets of digital comparators respectively connected to the outputs of said counter for identifying the types of the coins, each one of sets including a pair of digital comparators respectively set with an upper and lower limit of the result of integration concerning a specific type of the coin thus judging whether the inspected coin is genuine or conterfeit.

7. In coin inspection apparatus of the type wherein a differential transformer including at least two secondary coils is disposed along a coin passage, the improvement which comprises at least two detection coils constituting the secondary coils of said differential transformer and disposed along said coin passage at a spacing smaller than the diameter of a coin under inspection, said secondary coil each having an output level influenced by a coin passing along said coin passage and bridging the spacing between said secondary coils, and means for detecting the diameter of the coin in accordance with the output level of one detection coil when the output level of the other detection coil reaches a prederermined value.

8. A coin receiving apparatus comprising a coin passage defining member for receiving coins of different diameters, and coin inspecting means for classifying coins passing along said coin passage according to diameter, said coin inspecting means including two coin detecting coils positioned along said coin passage in spaced relation with the spacing between said coils being a distance less than the diameter of the smallest coin to be received in said coin passage, electrical circuit means coupled to each of said detecting coils for producing an output when influenced by a coin passing thereby, said detecting coils including a downstream coil, first level detecting means coupled to said downstream detecting coil for detecting when a leading edge of a coin reaches a predetermined position relative to said downstream detecting coil, and second level detecting means connected to the other of said detecting coils and coupled to said first level detecting means for actuation when a coin leading edge reaches said predetermined position to inspect the output of said other detecting coils, said second level detector having an output, and means for inspecting said second level detector output to determine the diameter of a coin overlapping said detecting coils.

* * * * *